US006773192B1

(12) United States Patent
Chao

(10) Patent No.: US 6,773,192 B1
(45) Date of Patent: Aug. 10, 2004

(54) LIGHT-EMITTING USB MOBILE DISK-PEN

(75) Inventor: Henry Chao, Taipei (TW)

(73) Assignee: PROSONIC Technology Corp., Taipei (TW)

( * ) Notice: Subject to any disclaimer, the term of this patent is extended or adjusted under 35 U.S.C. 154(b) by 0 days.

(21) Appl. No.: 10/715,355

(22) Filed: Nov. 19, 2003

(51) Int. Cl.[7] ..... B43K 29/00; B43K 5/16
(52) U.S. Cl. ..... 401/195; 401/116; 362/118
(58) Field of Search ..... 401/52, 195, 116; 362/118

(56) References Cited

U.S. PATENT DOCUMENTS 5,623,136 A * 4/1997 Schmid et al. ..... 235/30 R
6,439,734 B1 * 8/2002 Lo ..... 362/118
6,666,564 B1 * 12/2003 Su ..... 362/118

* cited by examiner

*Primary Examiner*—David J. Walczak
(74) *Attorney, Agent, or Firm*—Bacon & Thomas, PLLC

(57) ABSTRACT

A Ligth-Emitting USB portable disk-pen includes a USB plug that is inserted to a computer at an upper pen shaft, the USB plug is accommodated with a locating plate and joined as one body with a sheath. A printed circuit board is connected with one end of the sheath, penetrated into the sheath, and positioned along with the sheath in the upper pen shaft. The upper pen shaft is relative lighter in weight for not containing a refill, and is therefore steadier and less likely to wobble when being inserted to a computer, the LED at the PCB emits light via a bulb at the upper pen shaft, and thereby preventing poor contact quality of the USB plug.

1 Claim, 5 Drawing Sheets

LIGHT-EMITTING USB MOBILE DISK-PEN

BACKGROUND OF THE INVENTION (a) Field of the Invention

The invention relates to a USB plug for mobile flash drive and disposed at an upper end of a pen shaft, When being inserted to a USB receptacle of a computer, the light-emitting diode (LED) at the printed circuit board (PCB) emits light via a bulb at the upper pen shaft, thereby ensuring stability thereof when being inserted to a computer as well as enabling up-and-down adjustment of a refill within the pen shaft.

(b) Description of the Prior Art

Referring to FIG. 1 showing a common USB flash drive 100, wherein an USB plug 101 is inserted into a USB receptacle of a computer for accessing data. However, the flash drive 100 has no other purpose besides data storage, and is also rather awkward to carried along with. Industrialists have later developed a portable mobile disk-pen 200 as shown in FIG. 2, the pen comprises a USB plug 202 secured at a top end of a lower pen shaft 201. The USB plug 202 is stored in an upper pen sheath 203 when not in use, and an outer periphery of a refill 2011 at a lower end of the lower pen shaft 201 is fixed with a pen cap 204, such that the pen is both capable of writing and serving as a mobile disk. Yet, this prior mobile disk-pen 200 has the following drawbacks when put to practice:

1. The USB plug 202 is installed at the lower pen shaft 201, which has a relatively longer body and is heavier because of the refill 2011 contained. As a result, the USB plug 202 inevitably bears a relatively larger load when being inserted into a USB receptacle of a computer, and thus often leading to poor contact.

2. The USB plug 202 is joined with the lower pen shaft 201 via a connected single printed circuit board (PCB) 2021, and is therefore prone to wobble and again cause poor contact when being inserted into a USB receptacle of a computer.

3. The lower pen shaft 201 is secured with the USB plug 202 at an interior thereof, and thus no other refill can be replaced once the refill 2011 is consumed.

4. The outer periphery of the refill 2011 of the lower pen shaft 201 is necessarily accommodated within the pen cap 204, and the pen cap 204 is easily lost for that it is a separate part from the lower pen shaft 201.

5. The USB plug 202 inserted to a USB receptacle of a computer, the USB flash drive 100 can not emit light.

SUMMARY OF THE INVENTION

The primary object of the invention is to dispose a USB plug of a flash drive within an upper pen shaft, such that not only the USB plug offers better stability when being inserted to a computer, but also an upper pen shaft can emit light via a bulb.

DETAILED DESCRIPTION OF THE PREFERRED EMBODIMENTS

To better understand the invention, detailed descriptions shall be given with the accompanying drawings hereunder.

Figure 1:
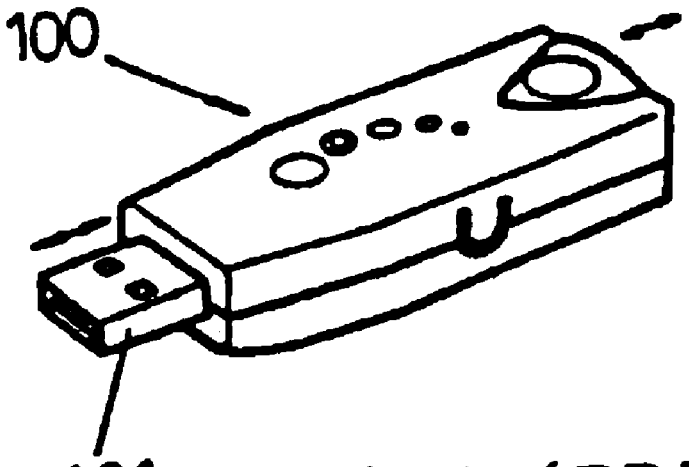
FIG.1 (PRIOR ART)
FIG. 1 shows a conventional elevational view of a prior art.
Figure 2:
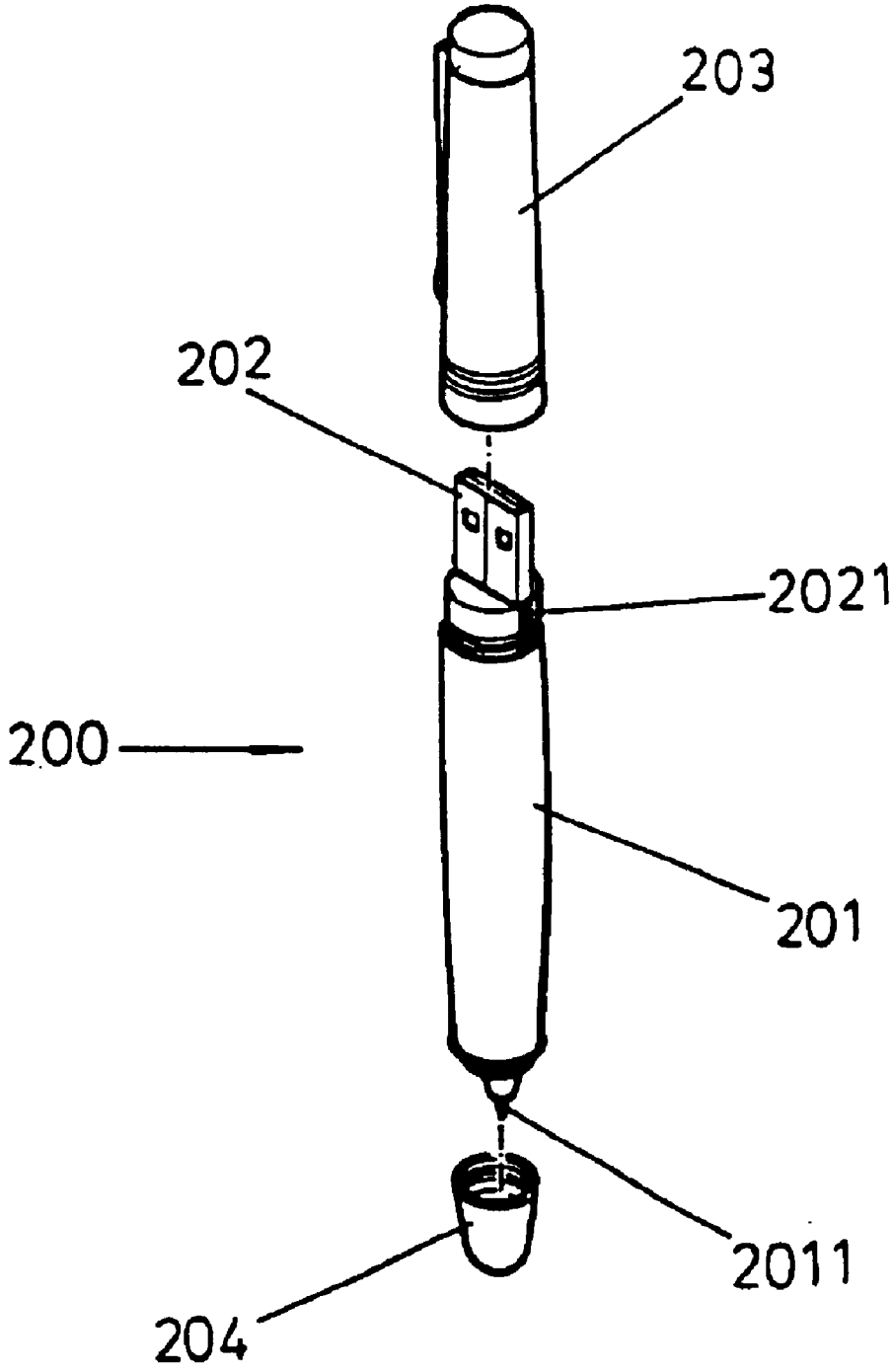
FIG.2 (PRIOR ART)
FIG. 2 shows a conventional exploded view of another prior art.
Figure 3:
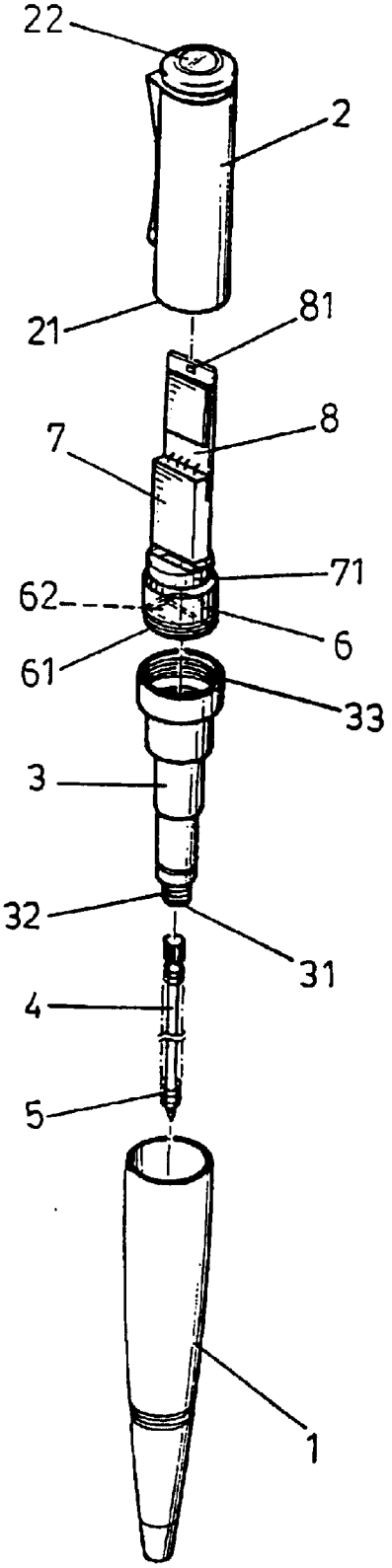
FIG. 3 shows an exploded view according to the invention.
Figure 4:
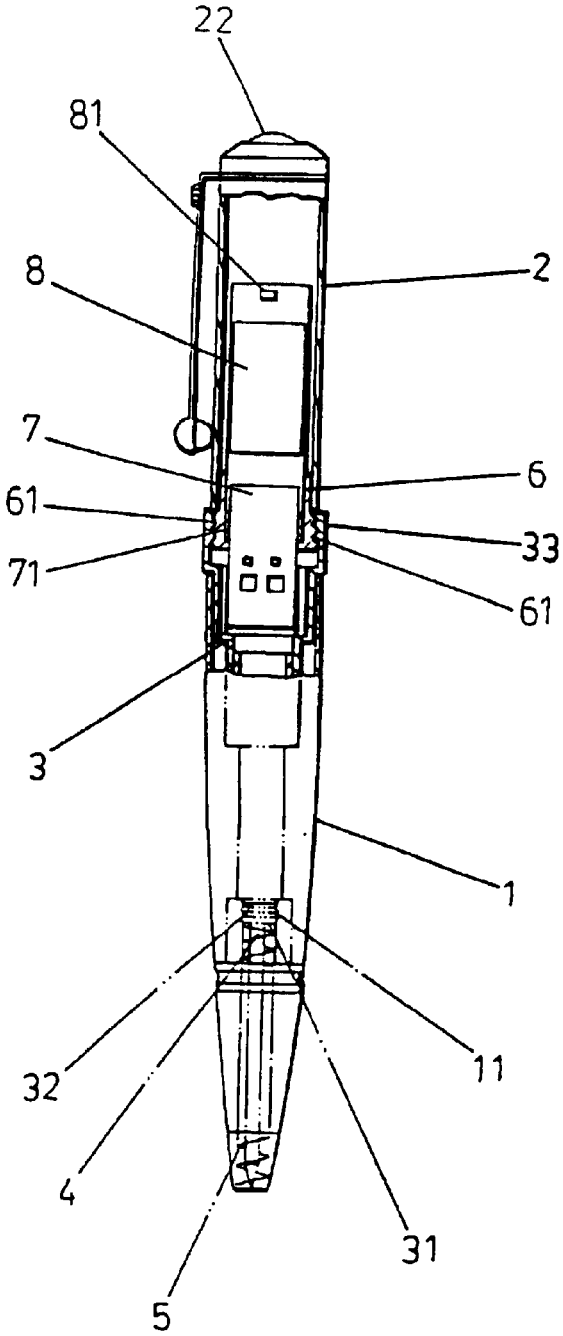
FIG. 4 shows a sectional view according to the invention.
Figure 5:
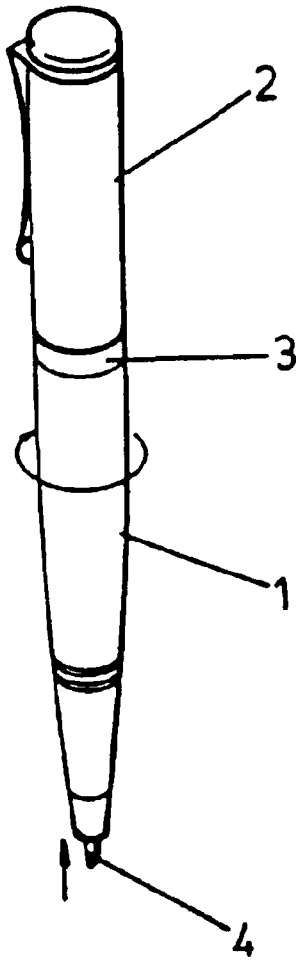
FIG. 5 shows a schematic view illustrating actions according to the invention.

Referring to FIGS. 3 and 4, the invention comprises a lower pen shaft 1, an upper pen shaft 2, a lower pen housing 3, a refill 4, a spring 5, a sheath 6, a USB plug 7 and a PCB 8. An upper portion of the refill 4 is simultaneously extended into a pen opening 31 at a lower end of the lower pen housing 3 when the refill 4 is penetrated through the spring 5. A lower outer periphery of the lower pen housing 3 is provided with a screw pillar 32 for coordinating with a screw opening 11 at an inner periphery of the lower pen shaft 1, thereby fastening the screw pillar 32 of the lower pen housing 3 into the screw opening 11 of the lower pen shaft 1 as shown in FIG. 4. When the screw pillar 32 of the lower pen housing 3 is turned to a lowermost position thereof, the lower pen housing 3 compresses the spring 5 and at the same time downward presses the refill 4 to outwardly stretch the lower pen shaft I as shown in FIG. 5. When the lower pen housing 3 is turned in an upward direction, the refilled 4 is withdrawn and restored into the lower pen shaft 1. In addition, an upper inner periphery of the lower pen shaft 3 is disposed with an internal screw thread 33.

Figure 7:
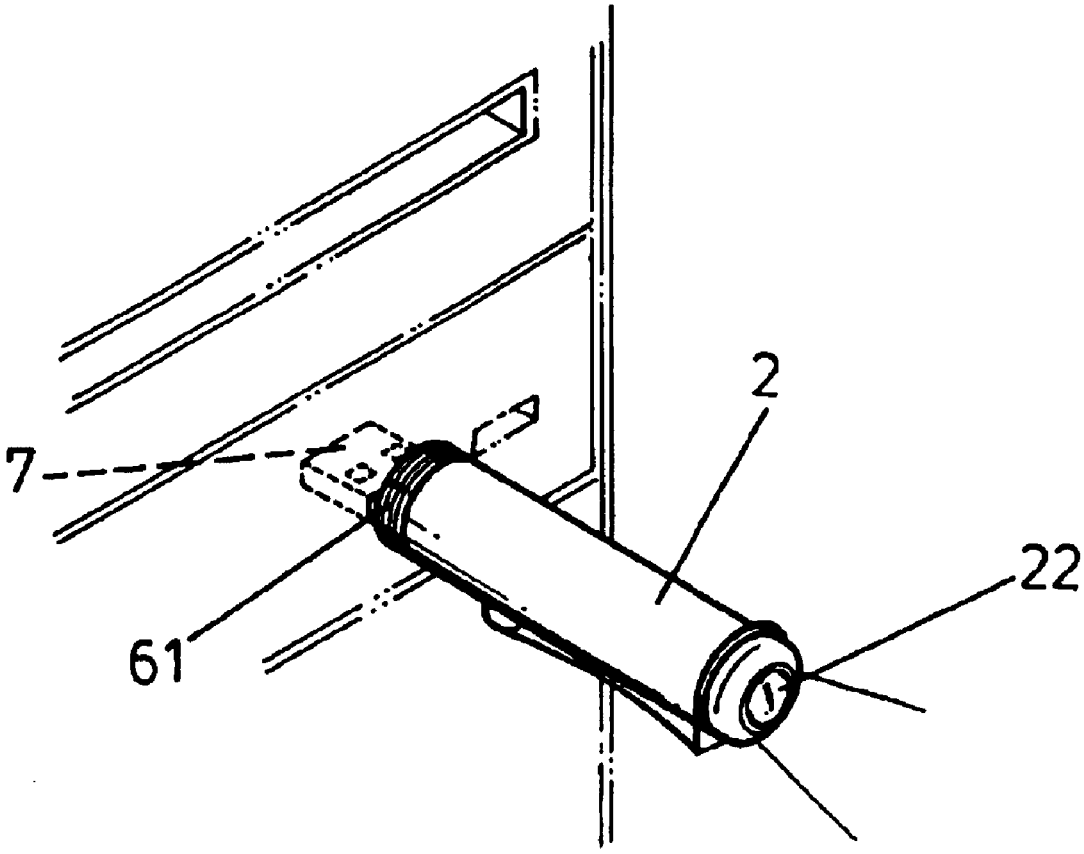
FIG. 7 shows another schematic view illustrating actions according to the invention.

The characteristics of the invention are that, the USB plug 7 is penetrated through an opening 62 of the sheath 6 to become joined as one body with the sheath 6; the front periphery of the USB plug 7 is accommodated within a locating plate 71 and extended into the sheath 6 as shown in FIG. 4. The PCB 8 connected with one end of the USB plug 7 is penetrated into the sheath 6; the sheath 6 and the PCB 8 are together inserted and secured in an only shaft opening 21 of the upper pen shaft 2; and a lower outer periphery of the sheath 6 is disposed with an external screw thread 61 for fastening with the internal screw thread 33 at the lower pen housing 3, thereby combining the upper and lower pen shafts 2 and 1 into one body as shown in FIG. 4. An upper portion of the PCB 8 is provided with a LED 81, an upper portion of the upper pen shaft 2 is provided with a bulb 22, when USB plug 7 is inserted to a USB receptacle of a computer, the LED 81 emits light via a bulb 22 at the upper pen shaft 2 as shown in FIG. 7.

Figure 6:
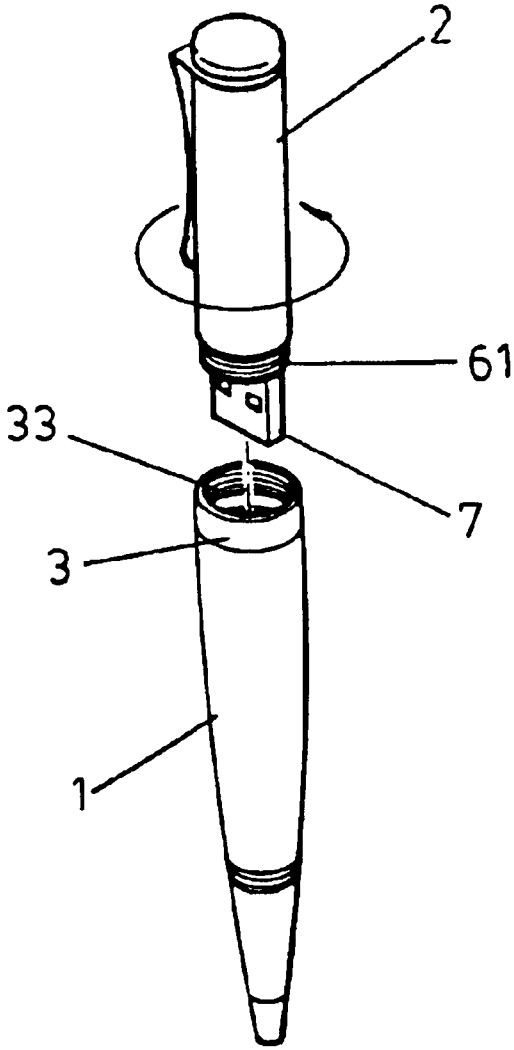
FIG. 6 shows a schematic view illustrating the upper and lower pen shafts according to the invention being separated.

Referring to FIG. 6, to insert the USB plug 7 into a USB receptacle of a computer, only the upper pen shaft 2 needs to be rotated, and the USB plug 7 positioned at a lower end of the upper pen shaft 2 may be separated from an opening of the lower pen housing 3.

Conclusive from the above, according to the invention, a USB plug is combined within an upper pen shaft, thereby overcoming the aforesaid drawbacks of prior inventions and bringing the following excellences:

1. The upper pen shaft 2 is relatively short and also lighter in weigh for not containing a refill. The USB plug 7 connected with the upper pen shaft 2 is steadier and does not incur poor contact when being inserted to a computer.
2. The USB plug 7 is directly combined with the sheath but not with a PCB 8 board having a smaller thickness, and therefore the USB plug 7 is less likely to wobble, and also offers better contact quality when being inserted to a computer.

3. The lower pen shaft 1 is not fixed with the USB plug 7, and hence the refill 4 in the lower pen shaft 1 may be designed as a structure capable of up-and-down adjustment, thereby eliminating parts such as a pen cap at an outer periphery of the refill 4.
4. The refill 4 in the lower pen shaft 1 is easily accessible on the market for replacement, thereby ensuring writing purposes at all time.
5. The LED 81 at the PCB 8 emits light via a bulb 22 at the upper pen shaft 2.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A Light-Emitting USB mobile disk-pen includes a lower pen shaft, an upper pen shaft, a lower pen housing, a refill, a spring, a sheath, a USB plug and a printed circuit board (PCB), wherein:

the refill is simultaneously extended into a pen opening at a lower end of the lower pen housing when being penetrated through the spring; one end of the lower pen housing is provided with a screw pillar for coordinating with a screw opening at an inner periphery of the lower pen housing, the refill is withdrawn or extended in the lower pen shaft through compression of the spring on the refill using the lower pen shaft; and the lower pen housing is provided with an internal screw thread; and the characteristics of the USB mobile disk-pen are that, the USB plug is penetrated through an opening of the sheath to become joined with the sheath, a locating plate is accommodated around the USB plug and extended into the sheath, and has one end thereof connected with the PCB that is penetrated into the sheath and together positioned with the sheath in a shaft opening of the upper pen shaft, whereas the other end thereof disposed with an external screw thread for fastening with the internal screw thread at the lower pen housing, thereby combining the upper and lower pen shafts into one body, an upper portion of the PCB is provided with LED, and when being inserted to a USB receptacle of a computer, the LED at the PCB emits light via a bulb at the upper pen shaft.

* * * * *